US006113466A

United States Patent [19]

Lin

[11] Patent Number: 6,113,466

[45] Date of Patent: Sep. 5, 2000

[54] APPARATUS AND METHOD FOR CONTROLLING POLISHING PROFILE IN CHEMICAL MECHANICAL POLISHING

[75] Inventor: Chih-Lung Lin, Taipei, Taiwan

[73] Assignee: Taiwan Semiconductor Manufacturing Co., Ltd., Hsin-Chu, Taiwan

[21] Appl. No.: 09/240,460

[22] Filed: Jan. 29, 1999

[51] Int. Cl.[7] ..... B24B 1/00

[52] U.S. Cl. ..... 451/41; 451/289

[58] Field of Search ..... 451/6, 8, 9, 10, 451/14, 28, 41, 42, 285, 287, 288, 397, 398, 913

[56] References Cited

U.S. PATENT DOCUMENTS

| | | | |
|---|---|---|---|
| 4,918,869 | 4/1990 | Kitta | 451/288 |
| 5,643,053 | 7/1997 | Shendon | 451/288 |
| 5,651,724 | 7/1997 | Kimura et al. | 451/288 |
| 5,766,058 | 6/1998 | Lee et al. | 451/287 |
| 5,820,448 | 10/1998 | Shamouilian et al. | 451/287 |
| 5,882,243 | 3/1999 | Das et al. | 451/288 |
| 5,913,719 | 6/1999 | Hasegawa et al. | 451/397 |

*Primary Examiner*—Derris H. Banks
*Attorney, Agent, or Firm*—Tung & Associates

[57] ABSTRACT

An apparatus and a method for controlling a polishing profile on a substrate during a polishing process are disclosed. In the apparatus for controlling the polishing profile on a silicon wafer during a CMP process, an elastic plate that has sufficient rigidity is used as a backing plate for a wafer to be polished. By deforming the elastic plate with a contour adjusting device, the curvature of the substrate to be polished can be changed from being convex to being concave, or vice versa. The present invention novel apparatus and method therefore allows the achievement of a more uniform thickness profile after a polishing process. The present invention novel method and apparatus farther allows an in-situ control of the curvature of a elastic plate during polishing and thus a specific thickness profile on the substrate surface.

23 Claims, 4 Drawing Sheets

| | | |
|---|---|---|
| MEAN | 4198.9 | |
| STD DEV | 197.32 | 4.699% |
| MINIMUM | 3765.1 | |
| MAXIMUM | 4581.2 | |
| # SITES/GOOD | 121/119 | |

APPARATUS AND METHOD FOR CONTROLLING POLISHING PROFILE IN CHEMICAL MECHANICAL POLISHING

FIELD OF THE INVENTION

The present invention generally relates to an apparatus for controlling polishing profile on a substrate during a polishing process and a method for using such apparatus and more particularly, relates to an apparatus for controlling polishing profile on a silicon wafer during a chemical mechanical polishing process by utilizing an elastic plate and a contour adjusting means for changing the contour of the wafer and a method for using the apparatus.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semi-conductor wafer during the fabrication of semi-conductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 chemical mechanical polishing consists of a rotating wafer holder 14 that holds the wafer 10 appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. Nos. 4,141180 to Gil, Jr., et al.; 5,205,082 to Shendon et al; and, 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan ® head which differs from conventional CMP heads in two major respects is shown. First, the Titan ® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

In the improved CMP head 20 shown in FIG. 1C, large variations in the removal rate, or polishing rate, across the whole wafer area are frequently observed. A thickness variation across the wafer is therefore produced as a mean cause for wafer non-uniformity. The improved CMP head design, even though utilizing a pneumatic system to force a wafer surface onto a polishing pad, the pneumatic system cannot selectively apply different pressure at different locations on the surface of the wafer. For instance, as shown in FIG. 4, a profilometer data obtained on an 8-inch wafer is shown. The thickness difference between the highest point on the wafer and the lowest point on the wafer is almost 2,000 Å yielding a standard deviation of 472 Å, or 6.26%. The curve shown in FIG. 4 is plotted with the removal rates in the vertical axis and the distance from the center of the wafer in the horizontal axis. It is seen that the removal rates at the edges of the wafer are substantially higher than the removal rate at or near the center of the wafer. The thickness uniformity on the resulting wafer after the CMP process is therefore very poor.

In the conventional polishing head of FIG. 1C, a wafer is held in the polishing head by a carrier film sandwiched between the wafer and the chuck. The carrier film provides the necessary elasticity. The rigid chuck and the carrier film apply uniform stress on the back of the wafer. However, it is frequently not possible to guarantee uniform polishing over the entire wafer surface due to other processing variables. For instance, the polishing slurry may not have been uniformly distributed under the entire wafer area, the pre-polishing thickness profile of the wafer prior to the CMP process may not have been uniform, and furthermore, the pad conditioning profile also may not have been uniform.

It is therefore an object of the present invention to provide an apparatus for controlling polishing profile on a substrate in a polishing process that does not have the drawbacks or shortcomings of the conventional apparatus.

It is another object of the present invention to provide an apparatus for controlling the polishing profile on a wafer during a CMP process that is capable of applying a selectively non-uniform pressure on the wafer surface.

It is a further object of the present invention to provide an apparatus for controlling a polishing profile on a wafer during a CMP process which is capable of applying a different pressure at the center of the wafer than that on the remaining area of the wafer.

It is another further object of the present invention to provide an apparatus for controlling a polishing profile on a wafer during a CMP process which utilizes an elastic plate as a backing plate for the wafer and a contour adjusting means for applying a pressure on the elastic plate to effectuate control of the contour of the wafer.

It is still another object of the present invention to provide an apparatus for controlling a polishing rate on a wafer during a CNP process which includes an elastic plate having sufficient rigidity made of BeCu alloy for changing the contour of the wafer.

It is yet another object of the present invention to provide an apparatus for controlling a polishing profile on a substrate during a CMP process which incorporates the use of a carrier film positioned between a wafer and an elastic plate for absorbing impact on the wafer during the polishing process.

It is still another further object of the present invention to provide a method for controlling a polishing profile on a substrate during a polishing process by mounting an elastic plate of sufficient rigidity behind a substrate and then deforming the elastic plate such that the contour of the substrate may be changed accordingly for changing the polishing profile.

It is yet another further object of the present invention to provide a method for controlling a polishing profile on a silicon wafer during a CMP process by utilizing an elastic plate and a carrier film behind the wafer such that the shape of the elastic plate may be changed from being concave to being convex to subsequently changing the polishing profile on the wafer surface.

SUMMARY OF THE INVENTION

In accordance with the present invention, an apparatus and a method for controlling polishing profile on a substrate during a polishing process are provided.

In a preferred embodiment, an apparatus for controlling polishing profile on a substrate during a polishing process can be provided which includes a polishing head that has a recessed opening adapted for holding a substrate therein and exposing a surface of the substrate to be polished, an elastic plate which has a diameter substantially similar to the substrate for fitting inside the recessed opening and for positioning between the substrate and the polishing head with a carrier film thereinbetween, the elastic plate has an elasticity and a rigidity sufficient to change a contour of the substrate from being convex to being concave, and a contour adjusting means adapted for applying a pressure on the elastic plate to effectuate control of the contour of the plate.

In the apparatus for controlling polishing profile on a substrate during a polishing process, the process may be a chemical mechanical polishing process. The substrate polished may be a silicon wafer. The elastic plate may be formed of metal or plastic. The elastic plate may be formed of a BeCu alloy. The carrier film may be formed of a material that has sufficient flexibility for reducing stresses on the substrate during polishing. The contour adjusting means may be at least one adjustable shaft for applying a pressure on the elastic plate. The contour adjusting means may be an adjustable shaft for applying a pressure at a center of the elastic plate. The apparatus may further include means for mounting the substrate, the carrier film and the elastic plate in the recessed opening of the polishing head.

The present invention is further directed to a method for controlling a polishing profile on a substrate in a polishing process which includes the operating steps of first providing a polishing head that has a recessed opening adapted for holding a substrate therein and for exposing a surface of the substrate to be polished, mounting an elastic plate of sufficient rigidity inside the recessed opening between the substrate and the polishing head with a carrier film sandwiched therein, mounting a contour adjusting means in contact with the elastic plate for controlling a concave or convex shape of the plate, and adjusting the contour adjusting means and changing the shape of the elastic plate such that the polishing profile on the substrate is changed.

The method for controlling a polishing profile on a substrate during a polishing process may further include the step of providing a polishing head for holding a silicon wafer therein. The method may further include the step of providing an elastic plate formed of a metal or a polymeric material. The method may further include the step of providing an elastic plate that is formed of a BeCu alloy. The method may further include the step of mounting a carrier film of sufficient flexibility for reducing stress on the substrate during polishing. The method may further include the step of providing the carrier film in a cellulosic foam structure.

In the method for controlling a polishing profile on a substrate during a polishing process, the polishing process conducted may be a chemical mechanical polishing process. The method may further include the step of providing the contour adjusting means in the form of a threaded bolt. The method may further include the step of changing the shape of the elastic plate to a convex such that a polishing rate at or near a center of the substrate is increased. The method may further include in the step of changing the shape of the elastic plate to a concave such that a polishing rate at or near a peripheral edge of the substrate may be increased.

In an alternate embodiment, an apparatus for controlling polishing profile on a wafer in a chemical mechanical polishing process is provided which includes a polishing head that has a recessed opening adapted for holding a wafer therein and for exposing a surface of the wafer to be polished, an elastic plate which has the same diameter as the wafer for fitting inside the recessed opening by positioning between the wafer and the polishing head a carrier film therein, the elastic plate has a sufficient rigidity for changing a polishing profile on the wafer, and a contour adjusting screw for exerting a pressure on the wafer at or near a center of the wafer for effectuating a change in the contour of the wafer from being convex to being concave.

In the apparatus for controlling polishing profile on a wafer in a chemical polishing method, the elastic plate may be provided in a material of BeCu alloy. The carrier film may be provided in a flexible cellulosic material for absorbing impact on the wafer during polishing. The contour adjusting screw effectuates a change in the contour of the wafer from being concave to being convex.

BRIEF DESCRIPTION OF THE DRAWING

These and other objects, features and advantages of the present invention will become apparent from the following detailed description and the appended drawings in which.

DETAILED DESCRIPTION OF THE PREFERRED EMBODIMENT

Figure 1A:
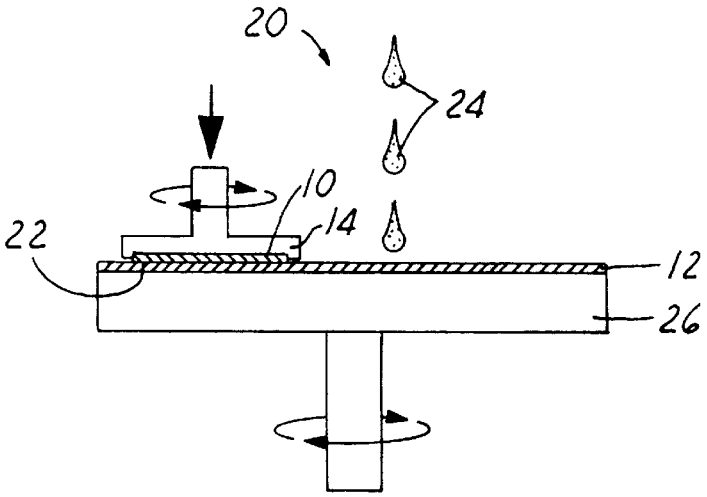
(Prior Art) FIG. 1A
FIG. 1A is a cross-sectional view of a conventional chemical mechanical polishing apparatus.
Figure 1B:
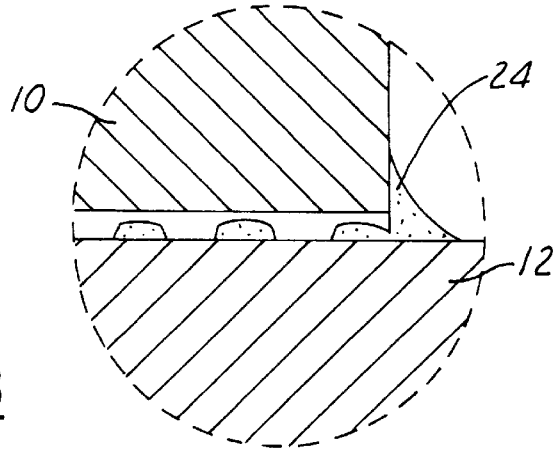
(Prior Art) FIG. 1B
FIG. 1B is a partial, enlarged cross-sectional view taken from FIG. 1A showing the interaction of slurry between the wafer and the polishing pad.
Figure 1C:
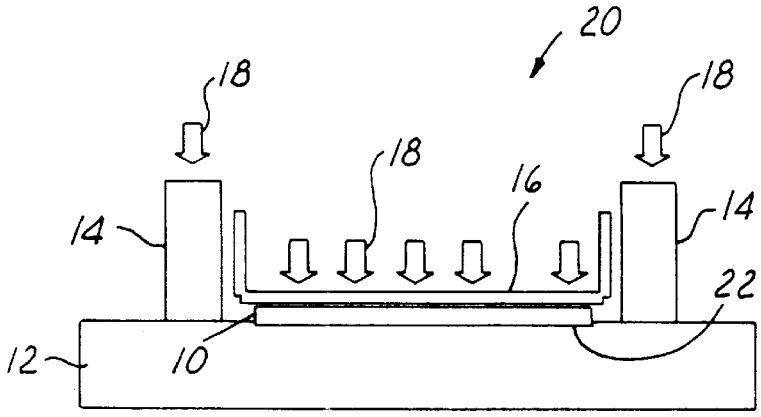
(Prior Art) FIG. 1C
FIG. 1C is a cross-sectional view illustrating an improved polishing head utilizing a membrane pressurizing device.

The present invention discloses an apparatus and a method for controlling polishing profile on an electronic substrate, such as a silicon wafer, during a polishing process. One of such polishing process widely used in semiconductor processing is a chemical mechanical polishing process. The apparatus is constructed by a polishing head which has a recessed opening on one end adapted for holding a substrate therein and for exposing a surface of the substrate to be polished, an elastic plate that has a diameter substantially similar to the substrate for fitting inside the recessed opening and for positioning between the substrate and the polishing head with a carrier film placed thereinbetween. The elastic plate has an elasticity and a rigidity sufficient to change a contour of the substrate, or the wafer, from being convex to being concave. The apparatus further includes a contour adjusting means, which may be suitably a threaded bolt for applying a pressure on the elastic plate at a position near the center of the plate to effectuate control of the contour of the plate and subsequently the contour of the substrate.

According to the present invention method, a polishing profile on a substrate during a polishing process may be controlled by the operating steps of first providing a polishing head which has a recessed opening provided therein for holding a substrate and for exposing a surface of the substrate to be polished, mounting an elastic plate of sufficient rigidity inside the recessed opening between the substrate and the polishing head with a carrier film sandwiched therein, mounting a contour adjusting means such as a threaded bolt in contact with the elastic plate for controlling a concave or a convex shape of the plate, and then adjusting the contour adjusting means and changing the shape of the elastic plate such that the polishing profile on the substrate may be changed.

The present invention novel apparatus is effective in correcting defects frequently seen in a conventional polishing head which causes variations in the removal rates across a wafer surface and thus producing poor wafer thickness uniformity. In the conventional polishing head design, the polishing pressure applied on the head cannot be controlled to a specific contour across the surface of the wafer. The present invention novel apparatus provides a means for adjusting the uniformity of removal rates across the surface of a wafer, and subsequently, a means for changing the thickness profile on the surface of the wafer. The present invention novel method further provides an in-situ controlled polishing pressure distribution on the wafer during a chemical mechanical polishing process. As a consequence, the wafer scale non-uniformity can be greatly improved while the thickness variation on the wafer may be minimized.

It is known in a chemical mechanical polishing process that the major components in the process which contributes to a wafer scale thickness profile are the downward force distribution applied and the distribution of the chemical slurry across the wafer surface. The present invention novel method provides a mechanical means that can be advantageously used to improve the thickness profile across a wafer surface.

In a conventional polishing head, a wafer is held on a wafer chuck by a carrier film that is sandwiched between the wafer and the chuck. The carrier film provides elasticity between the wafer and the chuck. A flat rigid chuck with a backing film applies uniform stress on the surface of the wafer. With the conventional apparatus, it is difficult to achieve an uniform polishing rate across the wafer surface. An uniform polishing rate is related to an uniform distribution of the chemical slurry on the entire wafer surface, the pre-polishing thickness profile before CMP and the pad conditioning profile. In the conventional process, new slurry material always flows to the peripheral edge of the wafer first, and thus the edge of the wafer always has an abundant supply of slurry than the center of the wafer. As a result, the edge of the wafer always polishes at a higher polishing rate.

Figure 2:
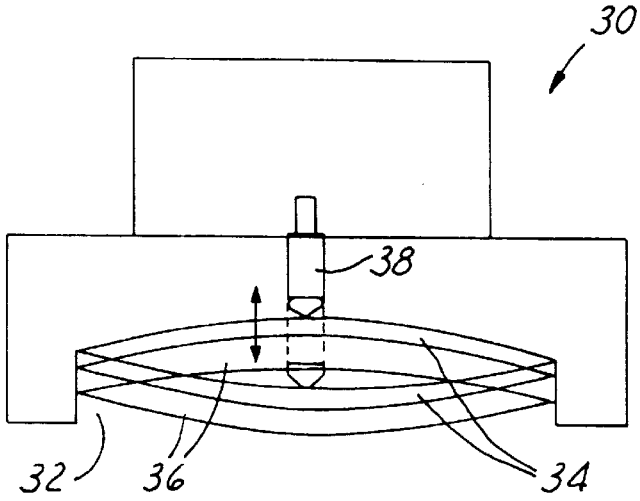
FIG. 2 is a cross-sectional view of the present invention apparatus for controlling polishing profile on a wafer in a CMP process.

The present invention novel apparatus and method compensate this effect by providing a novel polishing head which utilizes a slightly convex curvature on the carrier such that a higher pressure may be exerted at the center of the wafer. A new polishing head which is equipped with a flexible elastic plate is utilized to effectively control different downward force profile on the wafer surface. This is shown in FIG. 2, wherein a present invention polishing head 30 is provided with a recessed opening 32 equipped with an elastic plate 34 and a carrier film 36. It should be noted that the elastic plate 34 and the carrier film 36 are shown in a concave and a convex state. A contour adjusting means 38, or a threaded bolt, is used for applying a pressure on the elastic plate 34 to effectuate control of the contour of the plate 34. The material used for the elastic plate may be either a metallic material or a polymeric material. The material should be elastic but more rigid than the material used for the carrier film 36. A suitable material for the elastic plate is an alloy of BeCu, or any other metallic alloy or polymeric material that has the required elasticity and rigidity. The contour adjusting means 38 can be either a mechanical means, such as that shown in FIG. 2, or a pneumatic pressure means by using gas pressure (not shown).

The present invention novel apparatus enables an in-situ control of the curvature of elastic plate during a polishing process, i.e., during a CMP process. For instance, a CMP process can be advantageously carried out in two steps. In the first step, a convex curvature is used to exert a higher pressure at the center region of a substrate, or a wafer. In the second step, the pressure of the elastic plate can be released such that the elastic plate resumes a flat position to exert an uniform pressure on the entire substrate surface. The present invention novel apparatus 30 therefore allows a polishing process to be custom designed to suit a specific polishing application by changing the curvature of the elastic plate and selectively polishing designated areas on a substrate surface. In other words, different stress distributions can be applied on the surface of a substrate in order to achieve different thickness profiles on the substrate.

Figures 3A, 3B, 3C:
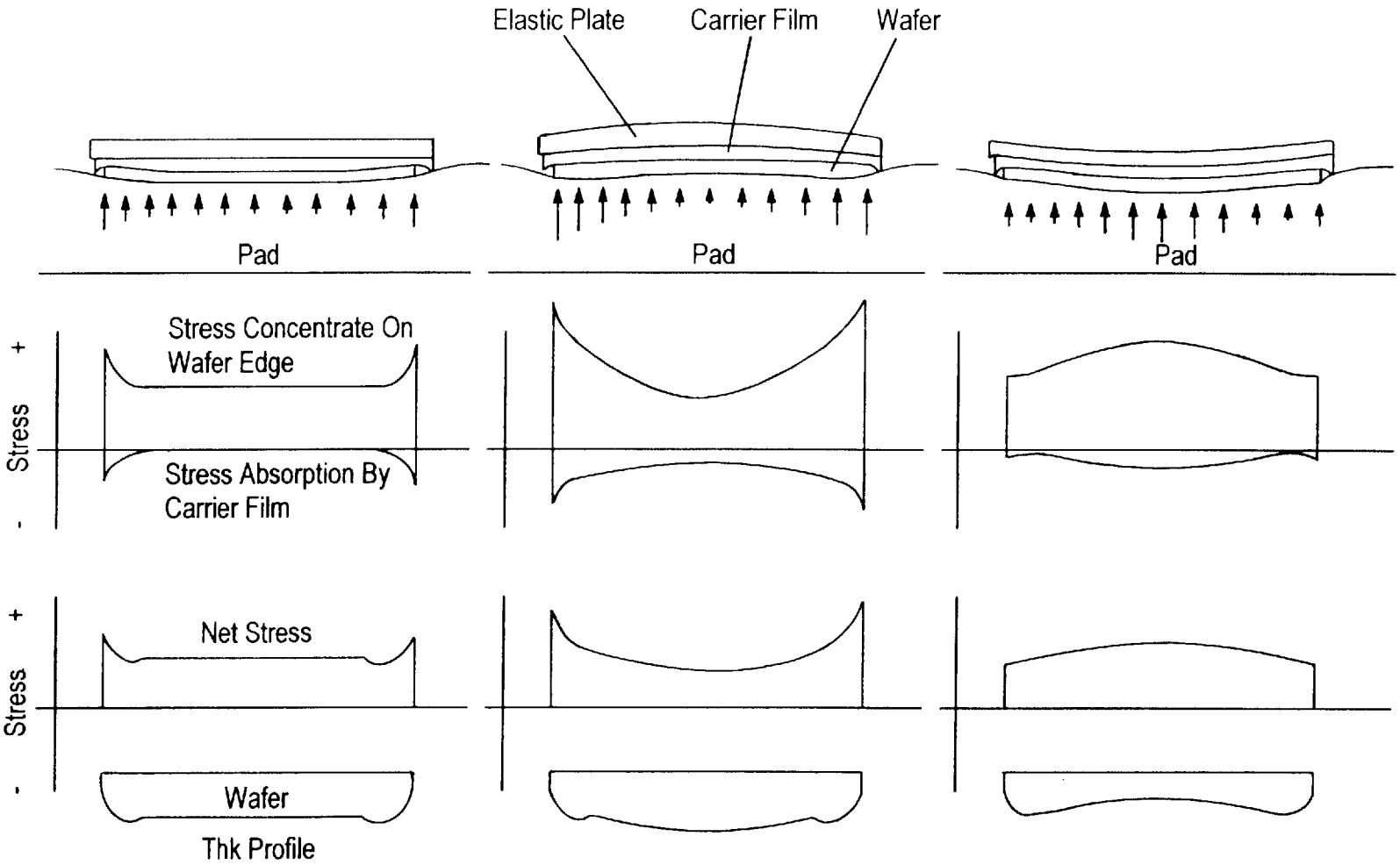
FIG. 3A is a cross-sectional view of the present invention polishing head with the elastic plate in an undeformed state and graphs of stress distribution data on the wafer.
FIG. 3B is a cross-sectional view of the present invention polishing head with the elastic plate in a concave state and graphs of the stress distribution data on the wafer.
FIG. 3C is a cross-sectional view of the present invention polishing head with the elastic plate in a convex state and graphs of the stress distribution data on the wafer.

Referring now to FIGS. 3A, 3B and 3C wherein the stress distribution curves are shown for the present invention novel apparatus when operated under different conditions, i.e., under different curvatures of the elastic plate 34. In FIG. 3A, the elastic plate is in an undeformed state, i.e., with no curvature. In this state, the present invention novel apparatus can be used in a similar manner to a conventional polishing disc by applying a uniform pressure on the entire substrate surface. As shown in the stress distribution curve, the stress concentrates on the substrate edges when an air pressure or a mechanical pressure is exerted on the substrate surface. In the negative region of the stress, a stress distribution curve for that absorbed by the carrier film is also shown. A net stress is resulted from a balance between the positive stress and the negative stress and shown in the bottom curve of FIG. 3A. The thickness profile obtained on the surface of the substrate is also shown in FIG. 3A as a flat surface. In FIG. 3B, the elastic plate is allowed to curve in a concave manner resulting in different stress distribution curves and a different thickness profile on the wafer surface, on the convex surface. FIG. 3C shows the elastic plate being deformed to a curvature of a convex resulting in still different stress distribution curves and a different thickness profile on the substrate, i.e., a concave surface. This is caused by the higher pressure at the center of the substrate resulting in a higher removal rate at the center region. It is therefore shown by the present invention novel method that the removal rate, or the polish rate, is proportional to the pressure exerted on the wafer.

As shown in FIG. 3, the present invention novel method and apparatus enable the control of different downward pressure profiles on a substrate surface in order to compensate other polishing effects for achieving an uniform polishing profile. In the present invention novel method, an in-situ adjustment of the polishing pressure can be carried out on a substrate during a polishing process without the need of stopping the process. With the present invention novel method, it is possible to obtain different post-thickness profiles for meeting specific requirements for process integration considerations.

Figure 6:
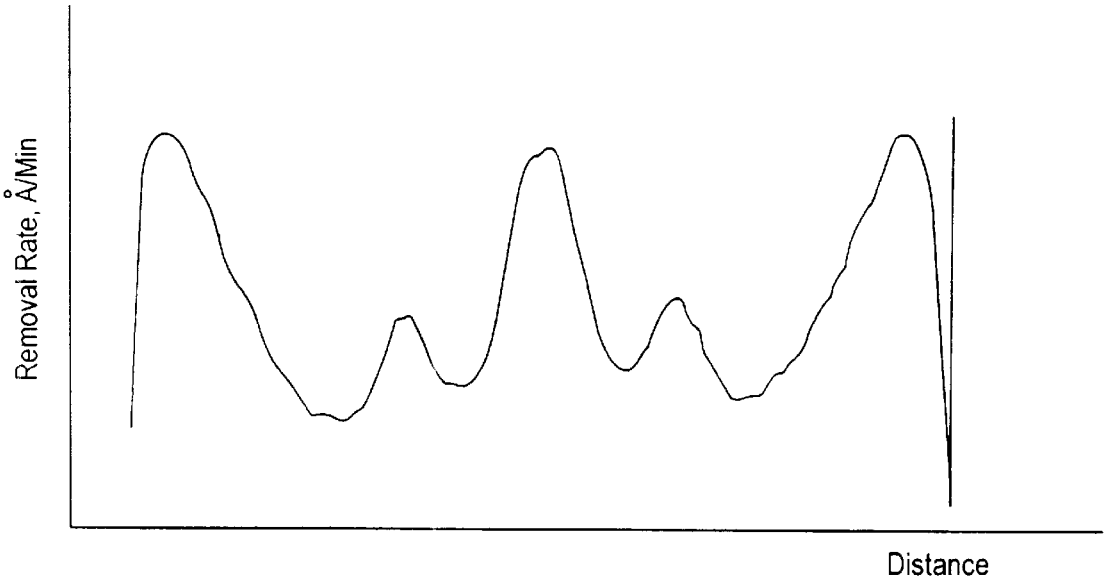
FIG. 6 is a graph illustrating data obtained on the present invention polishing head with a 3-inch diameter and a 5-inch diameter padding showing the removal rate dependence on the distance from the wafer center.
Figure 4:
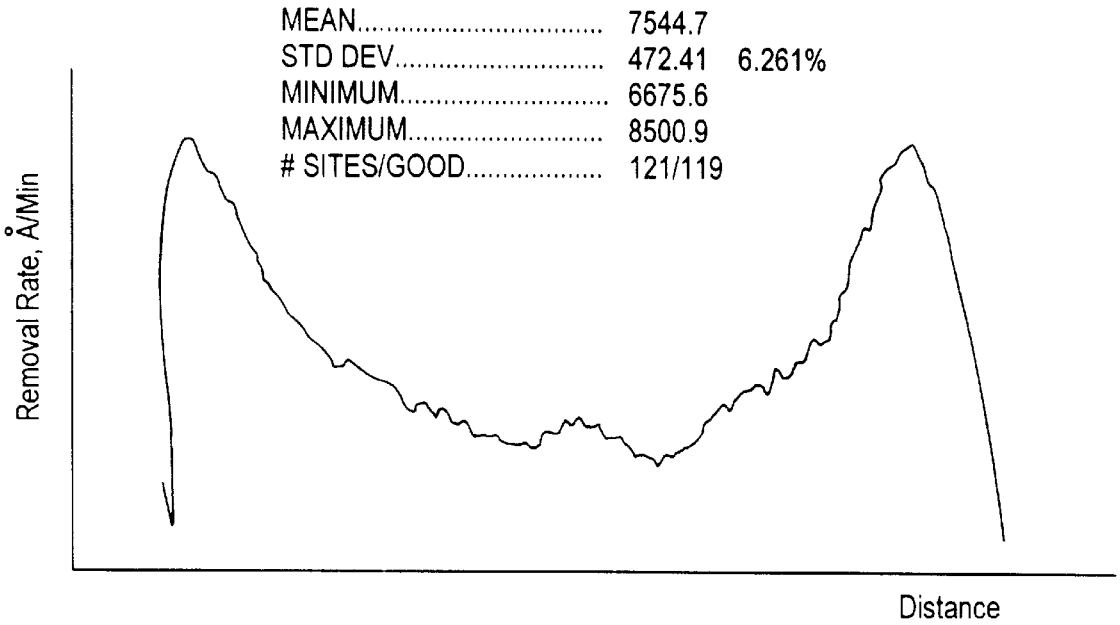
(Prior Art) FIG. 4
FIG. 4 is a graph illustrating data obtained on a conventional polishing head showing the removal rate dependence on the wafer surface.
Figure 5:
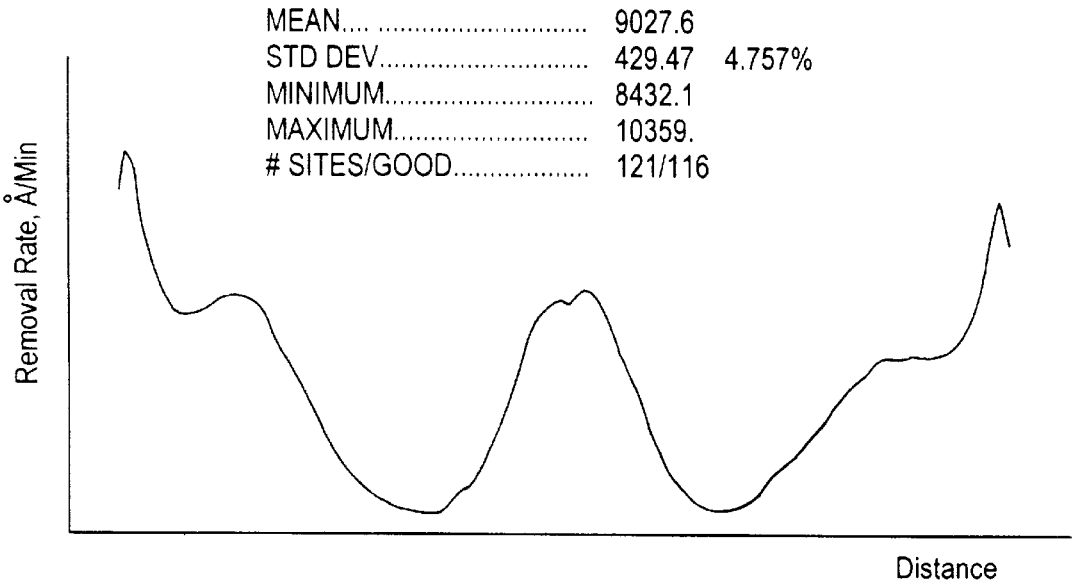
FIG. 5 is a graph illustrating data obtained on the present invention polishing head with a 3-inch diameter padding showing the removal rate dependence on the distance from the wafer center.

The beneficial effect of the present invention is shown in FIGS. 5, 6 which can be compared to data shown in FIG. 4 obtained on a conventional polishing head. Data in FIG. 5 is obtained in a simulation of the present invention method by using a 3-inch diameter pad under a flat plate and similar to a curvature that is formed by an elastic plate. It is seen that the removal rate is higher at the center of the substrate, or the wafer. The overall thickness profile obtained on the substrate surface is improved over that shown in FIG. 4 by the conventional method. The maximum thickness difference obtained at the highest point and at the lowest points on the wafer surface is approximately 1600 Å which is substantially smaller than that obtained in FIG. 4. Furthermore, the standard deviation achieved by the present invention novel apparatus ( i.e., by the simulated method) shown in FIG. 5 is 4.75%. This is significantly smaller than the standard deviation of 6.26% obtained by the conventional apparatus of FIG. 4. The present invention novel apparatus therefore enables a more uniform thickness profile being achieved on the surface of a substrate.

FIG. 6 shows another simulation of the present invention novel apparatus by the incorporation of a 3-inch diameter and a 5-inch diameter pad. The two pads are stacked together and placed on a flat plate to simulate an elastic plate being deformed more severely than that shown in FIG. 5. It is seen from the thickness profile shown in FIG. 6 that a more uniform thickness on the substrate is achieved. The maximum and the minimum height difference is approximately 800 Å which is further improved from data shown in FIG. 5. Furthermore, the standard deviation calculated from data in FIG. 6 is only 4.69% which compares favorably to data shown in both FIG. 5 and FIG. 4. The present invention novel method and apparatus achieve a substantially improved polishing result on a silicon wafer than that possible by the conventional polishing head. This is clearly shown in FIGS. 5 and 6.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. An apparatus for controlling polishing profile on a substrate in a polishing process comprising:

a polishing head having a recessed opening adapted for holding a substrate therein and for exposing a surface to be polished, an elastic plate for fitting inside said recessed opening and for positioning between said substrate and said polishing head with a carrier film inserted therein, said elastic plate having an elasticity and rigidity sufficient to change a contour of said substrate from being convex to being concave, and a contour adjusting screw for applying a pressure on said elastic plate to effectuate control of the contour of said plate.

2. An apparatus for controlling polishing profile on a substrate in a polishing process according to claim 1, wherein said polishing process is a chemical mechanical polishing process.

3. An apparatus for controlling polishing profile on a substrate in a polishing process according to claim 1, wherein said substrate to be polished is a silicon wafer.

4. An apparatus for controlling polishing profile on a substrate in a polishing process according to claim 1, wherein said elastic plate is formed of metal or plastic.

5. An apparatus for controlling polishing profile on a substrate in a polishing process according to claim 1, wherein said elastic plate is formed of a BeCu alloy.

6. An apparatus for controlling polishing profile on a substrate in a polishing process according to claim 1, wherein said carrier film is formed of a material having sufficient flexibility for reducing stresses on said substrate during polishing.

7. An apparatus for controlling polishing profile on a substrate in a polishing process according to claim 1, wherein said contour adjusting screw is at least one adjustable shaft for applying pressure on said elastic plate.

8. An apparatus for controlling polishing profile on a substrate in a polishing process according to claim 1, wherein said contour adjusting screw is an adjustable shaft for applying a pressure at a center of said elastic plate.

9. An apparatus for controlling polishing profile on a substrate in a polishing process according to claim 1 further comprising means for mounting said substrate, said carrier film and said elastic plate in said recessed opening of the polishing head.

10. A method for controlling a polishing profile on a substrate in a polishing process comprising the steps of:

providing a polishing head having a recessed opening adapted for holding a substrate therein and for exposing a surface to be polished, mounting an elastic plate of sufficient rigidity inside said recessed opening between said substrate and said polishing head with a carrier film sandwiched therein, mounting a contour adjusting screw in contact with said elastic plate for controlling a concave or convex shape of said plate, and adjusting said contour adjusting screw and mechanically changing the shape of said elastic plate such that the polishing profile on said substrate is changed.

11. A method for controlling a polishing profile on a substrate in a polishing process according to claim 10 further comprising the step of providing a polishing head for holding a silicon wafer therein.

12. A method for controlling a polishing profile on a substrate in a polishing process according to claim 10 further comprising the step of providing an elastic plate formed of a metal or a polymeric material.

13. A method for controlling a polishing profile on a substrate in a polishing process according to claim 10 further comprising the step of providing an elastic plate formed of a BeCu alloy.

14. A method for controlling a polishing profile on a substrate in a polishing process according to claim 10 further comprising the step of mounting said carrier film of sufficient flexibility for reducing stress on said substrate during polishing.

15. A method for controlling a polishing profile on a substrate in a polishing process according to claim 10 further comprising the step of providing said carrier film in a cellulosic foam structure.

16. A method for controlling a polishing profile on a substrate in a polishing process according to claim 10, wherein said polishing process conducted is a chemical mechanical polishing process.

17. A method for controlling a polishing profile on a substrate in a polishing process according to claim 10 further comprising the step of providing said contour adjusting screw in the form of a threaded bolt.

18. A method for controlling a polishing profile on a substrate in a polishing process according to claim 10 further comprising the step of changing the shape of said elastic plate to a convex such that a polishing rate at a center of the substrate is increased.

19. A method for controlling a polishing profile on a substrate in a polishing process according to claim 10 further comprising the step of changing the shape of said elastic plate to a concave such that a polishing rate at a peripheral edge of the substrate is increased.

20. An apparatus for controlling polishing profile on a wafer in a chemical mechanical polishing process comprising:

a polishing head having a recessed opening adapted for holding a wafer therein and for exposing a surface of the wafer to be polished, an elastic plate wafer for fitting inside said recessed opening by positioning between said wafer and said polishing head a carrier film therein, said elastic plate having sufficient rigidity for changing a polishing profile on said wafer, and a contour adjusting screw for exerting a pressure on said wafer at a center of said wafer for effectuating a change in said contour of the wafer from being convex to being concave.

21. An apparatus for controlling polishing profile on a wafer in a chemical mechanical polishing process according to claim 20, wherein the elastic plate may be provided in a material of BeCu alloy.

22. An apparatus for controlling polishing profile on a wafer in a chemical mechanical polishing process according to claim 20, wherein said carrier film is provided in a flexible cellulosic material for absorbing impact on said wafer during polishing.

23. An apparatus for controlling polishing profile on a wafer in a chemical mechanical polishing process according to claim 20, wherein said contour adjusting screw effectuates a change in said contour of the wafer from being concave to being convex.

* * * * *